US008087945B2

(12) United States Patent
Allwood

(10) Patent No.: US 8,087,945 B2
(45) Date of Patent: Jan. 3, 2012

(54) ELECTRIC CONNECTOR WITH A DUST COVER

(75) Inventor: Brent David Allwood, Buttaba (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/531,141

(22) PCT Filed: Jul. 18, 2007

(86) PCT No.: PCT/EP2007/006370

§ 371 (c)(1),
(2), (4) Date: Feb. 11, 2010

(87) PCT Pub. No.: WO2008/110190

PCT Pub. Date: Sep. 18, 2008

(65) Prior Publication Data

US 2010/0144188 A1 Jun. 10, 2010

(30) Foreign Application Priority Data

Mar. 14, 2007 (AU) ..... 2007901337

(51) Int. Cl.
*H01R 13/44* (2006.01)

(52) U.S. Cl. ..... 439/135; 439/676

(58) Field of Classification Search ..... 439/135, 439/138, 417, 418, 404, 676, 387, 689
See application file for complete search history.

(56) References Cited

U.S. PATENT DOCUMENTS

| | | | | |
|---|---|---|---|---|
| 4,405,187 | A * | 9/1983 | Muller et al. | 439/607.05 |
| 4,452,502 | A * | 6/1984 | Forberg et al. | 439/409 |
| 5,059,140 | A | 10/1991 | Philippson et al. | 439/607.02 |
| 5,249,987 | A | 10/1993 | Kristiansen | 439/676 |
| 5,655,934 | A | 8/1997 | Gow et al. | 439/676 |
| 5,752,858 | A * | 5/1998 | Gow et al. | 439/676 |
| 6,309,247 | B1 | 10/2001 | Wang | 439/521 |
| 6,494,747 | B1 * | 12/2002 | Hwang | 439/676 |
| 7,083,472 | B2 * | 8/2006 | Gordon et al. | 439/607.48 |

FOREIGN PATENT DOCUMENTS

| | | |
|---|---|---|
| DE | 43 11 183 | 10/1994 |
| DE | 44 25 748 | 7/1995 |
| DE | 102 58 725 | 6/2004 |
| GB | 2 360 880 | 10/2001 |
| KR | 10-0537997 B1 | 12/2005 |

OTHER PUBLICATIONS

Examination Report from a related Australian patent application citing the references listed above including KR 1020010095989 A, which is the unexamined published application of the registered patent KR 10-0537997 B1 listed above, Aug. 2, 2010.
English machine translation of the registered patent KR 10-0537997 B1.

* cited by examiner

*Primary Examiner* — Javaid Nasri
(74) *Attorney, Agent, or Firm* — Merchant & Gould P.C.

(57) ABSTRACT

The invention relates to an electric connector (100) having electric contact elements (206) to which an electric contact may be established using contacts of a matching plug by insertion of the plug into the electric connector (100) via an outlet (202), said electric connector also comprising a hollow space (106) in which a substantial intermediate length of one or more electric contact elements (206) is exposed via an upper input (110), and a dust cover (108), attachable in a removable fashion via the upper input (110) in order to prevent impurities from entering the hollow space (106).

20 Claims, 8 Drawing Sheets

ELECTRIC CONNECTOR WITH A DUST COVER

This application is a National Stage Application of PCT/EP2007/006370, filed 18 Jul. 2007, which claims benefit of Serial No. 2007901337, filed 14 Mar. 2007 in Australia and which application(s) are incorporated herein by reference. To the extent appropriate, a claim of priority is made to each of the above disclosed applications.

TECHNICAL FIELD OF THE INVENTION

The present invention relates to an electrical connector having a dust cover.

BACKGROUND OF THE INVENTION

Electrical connectors, for example RJ-type connectors, are useful for providing wall sockets where electronic data cables can be terminated and mating electrical plugs can be inserted. A problem with such electrical connectors can occur when dust, dirt or other contaminants come into contact with electrically conductive elements inside the connector. Such contaminants may cause corrosion, unintended conduction or adhesion of components that impedes their movement. Ingress of contaminants into the electrical connector may be particularly likely when the connector is placed in a wall cavity. This may be the case when building works generate abrasions and contaminants, for example.

Some electrical connectors, such as some RJ-type connectors, are assembled in such a way that an exposed cavity containing one or more conductive elements of the electrical connector is not covered in the manufacture and assembly of the main components of the electrical connector. This exposed cavity may be prone to accumulation of contaminants.

It is generally desirable to overcome or ameliorate one or more of the above described difficulties, or at least provide a useful alternative.

SUMMARY OF THE INVENTION

In accordance with one aspect of the present invention there is provided an electrical connector including:

(a) electrical contact elements to which electrical contact can be made with contacts of a mating plug by insertion of the plug into the electrical connector through a socket;

(b) a cavity, in which a substantial intermediate length of one or more electrical contact elements is exposed via a top entrance; and (c) a dust cover, coupled to the top entrance to inhibit ingress of foreign matter into the cavity.

In accordance with another aspect of the present invention there is provided an in-line RJ-type electrical connector including:

(a) electrical contact elements to which electrical contact can be made with contacts of a mating plug by insertion of the plug into the connector;

(b) a cavity, in which a substantial intermediate length of one or more electrical contact elements is exposed via a top entrance; and (c) a dust cover, coupled to the top entrance to inhibit ingress of foreign matter into the cavity.

In accordance with another aspect of the present invention there is provided a method of assembling an electrical connector having first and second portions, including steps of:

(a) seating a plurality of insulation displacement contacts, which are connected to a corresponding plurality of electrical contact elements, in the second portion;

(b) slideably inserting the second portion into the first portion so that the electrical contact elements move through a top entrance of the first portion and become seated in a corresponding plurality of internal slots in a cavity of the first portion; and (c) attaching a dust cover over the top entrance of the cavity.

In accordance with another aspect of the present invention there is provided an electrical connector for electrically connecting electrically conductive insulated conductors of a first cable to corresponding electrically conductive insulated conductors of a second cable, including:

(a) a first portion including a socket shaped to at least partially receive a terminal end of a plug terminating the conductors of the first cable;

(b) a plurality of electrically conductive contact elements that include first ends at least partially extending into the socket for electrical connection to corresponding conductors of the first cable, and second ends including insulation displacement contacts for electrically connecting to corresponding conductors of the second cable;

(c) a second portion including a plurality of slots shaped to at least partially receive and locate respective ones of said contact elements in predetermined positions such that insulation displacement contacts of the contact elements extend into respective openings of the second portion for connection to corresponding conductors of the second cable; and (d) a cover, wherein the first portion includes a cavity that facilitates lateral movement of the first portion over the second portion when the contact elements are seated in respective slots of the second portion so as to couple the first portion to the second portion, and the cover is coupled over the cavity to inhibit ingress of foreign matter into the connector.

BRIEF DESCRIPTION OF THE DRAWINGS

Preferred embodiments of the present invention are hereinafter described, by way of non-limiting example only, with reference to the accompanying drawings, in which.

DETAILED DESCRIPTION OF PREFERRED EMBODIMENTS OF THE INVENTION

Figure 1:
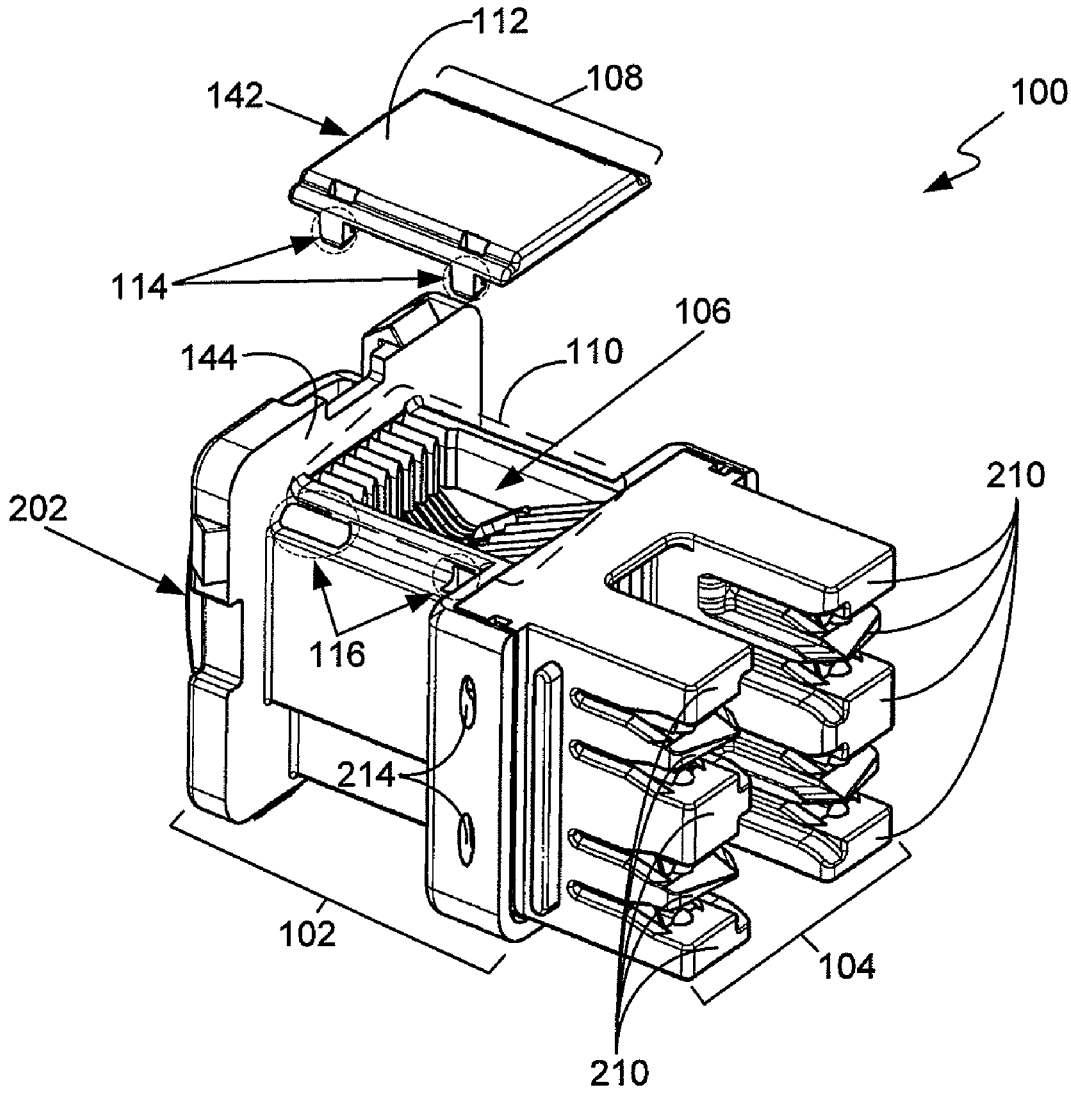
FIG. 1 is a partially exploded perspective view of an electrical connector including a dust cover.
Figure 2:
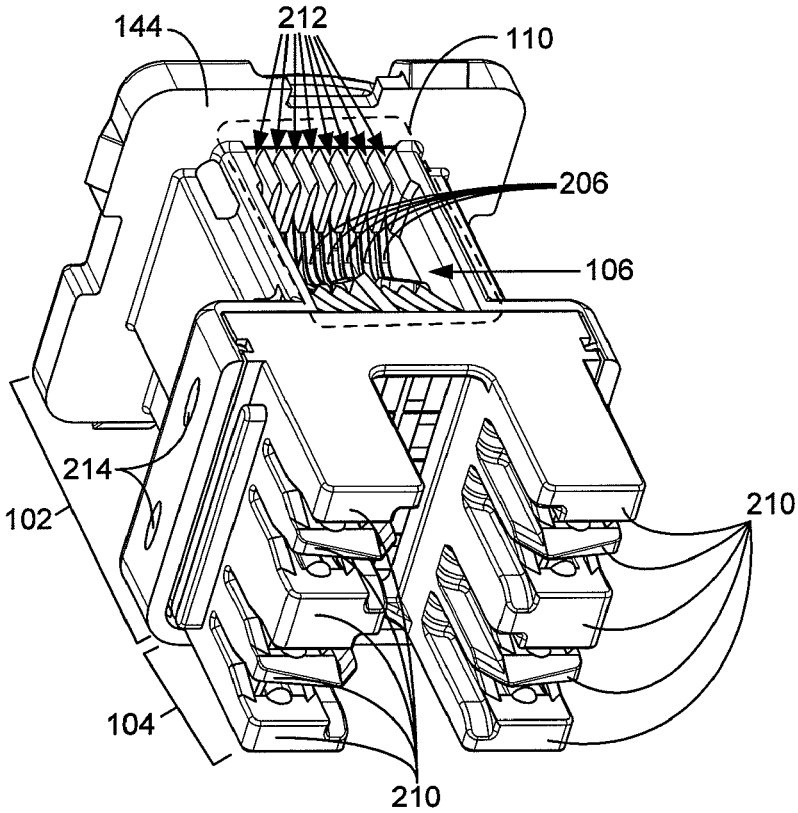
FIG. 2 is a perspective view of the electrical connector shown in FIG. 1 with the dust cover removed.
Figure 3:
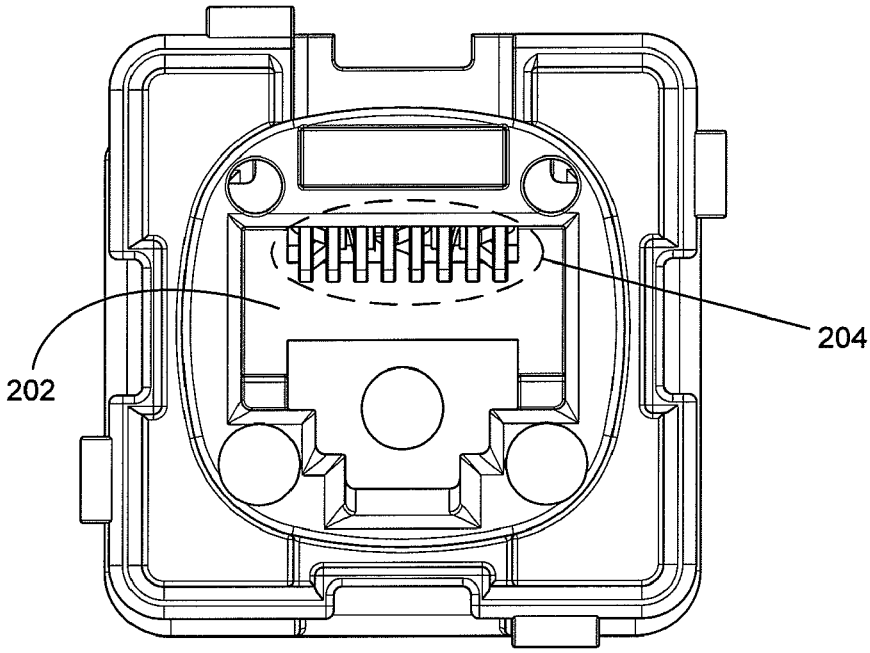
FIG. 3 is a front view of the electrical connector shown in FIG. 1.
Figure 4:
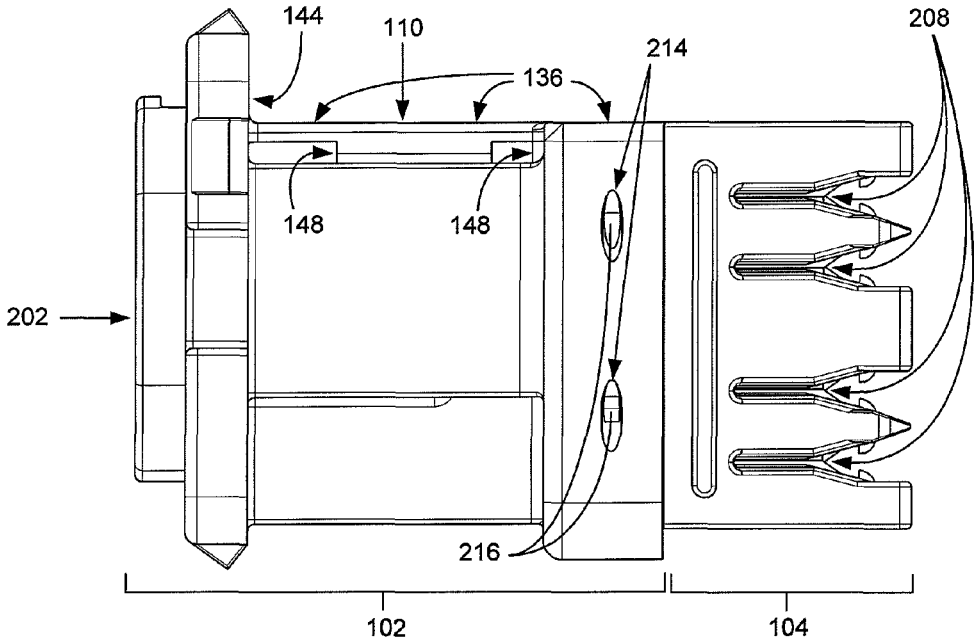
FIG. 4 is a side view of the electrical connector shown in FIG. 1 with the dust cover removed.
Figure 5:
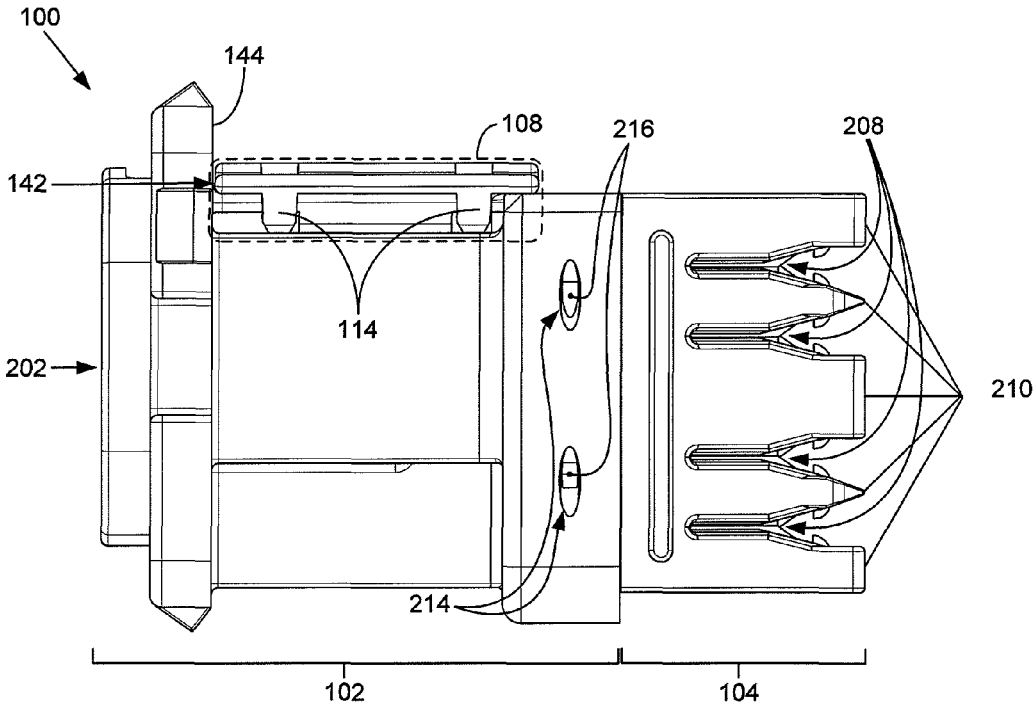
FIG. 5 is a side view of the electrical connector shown in FIG. 1 with the dust cover in place.
Figure 6:
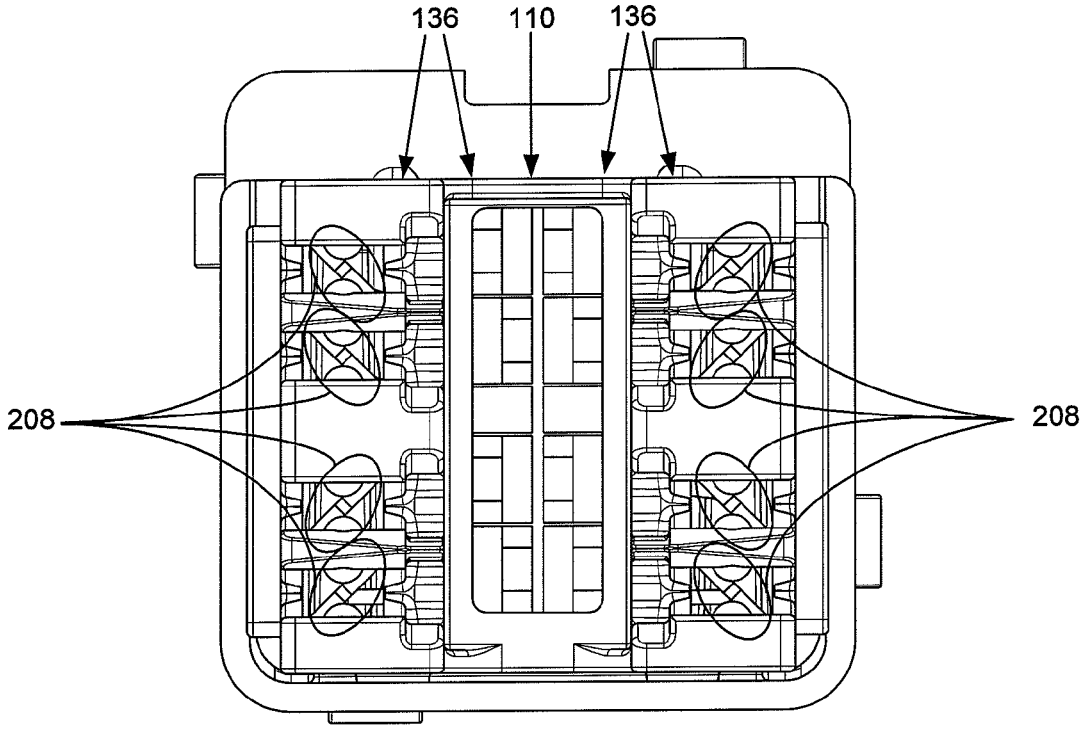
FIG. 6 is a back view of the electrical connector shown in FIG. 1 with the dust cover removed.
Figure 7:
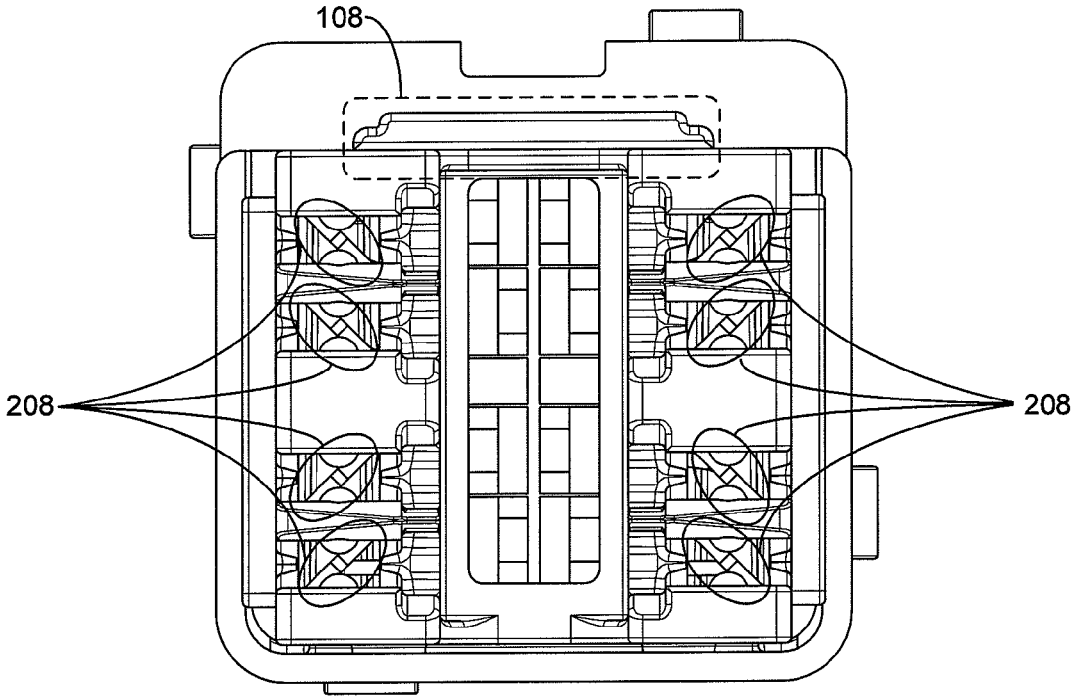
FIG. 7 is a back view of the electrical connector shown in FIG. 1 with the dust cover in place.
Figure 8:
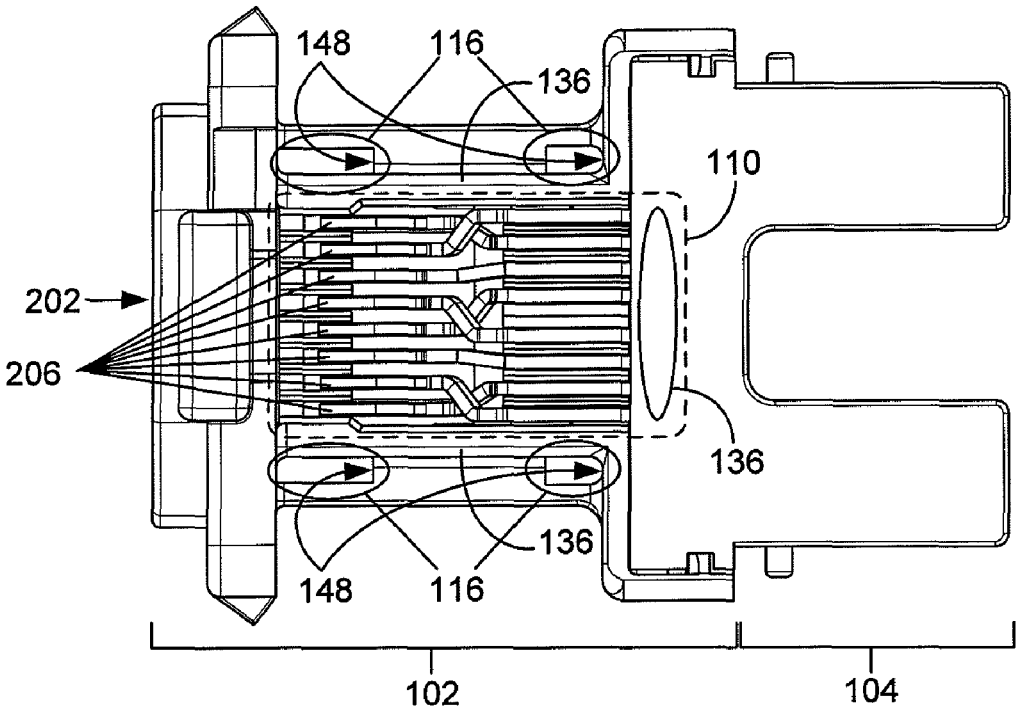
FIG. 8 is top view of the electrical connector shown in FIG. 1 with the dust cover removed.
Figure 9:
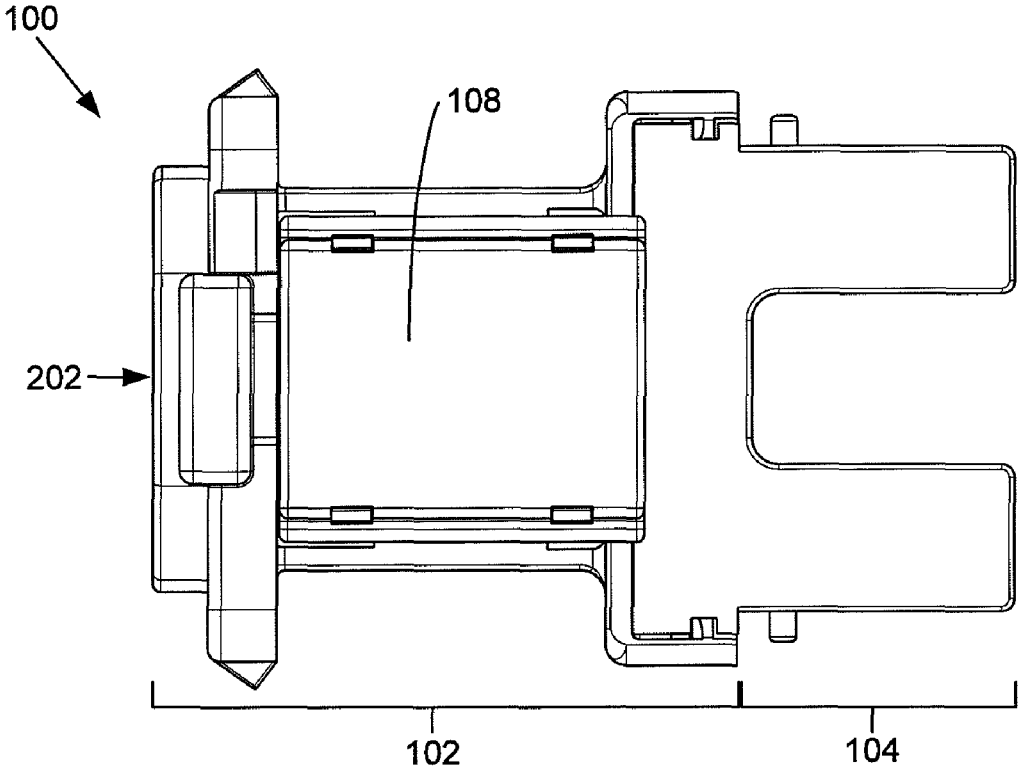
FIG. 9 is a top view of the electrical connector shown in FIG. 1 with the dust cover in place.
Figure 10:
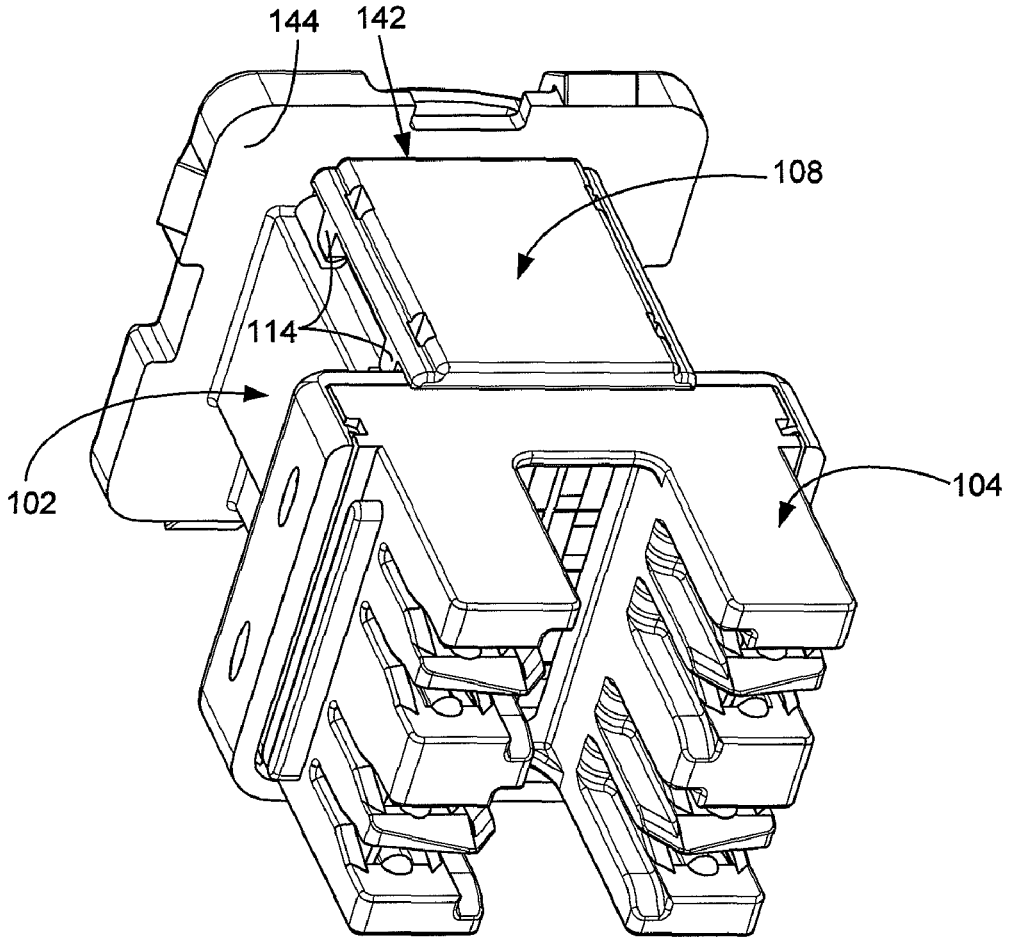
FIG. 10 is a perspective view of the electrical connector shown in FIG. 1 with the dust cover in place.

The electrical connector 100 shown in FIGS. 1 to 10 is an in-line RJ-type connector, for example. The connector 100 is used to connect insulation-coated electrically conductive wires of a first cable to corresponding electrically conductive wires of a second cable that is terminated by a plug. As particularly shown in FIG. 3, the connector 100 includes a socket 202 that is shaped to receive a terminal end of the plug such that electrically conductive contacts of the plug electrically engage with respective ones of first ends 204 of electrical contact elements 206 seated in the socket 202. As particularly shown in FIGS. 4 and 5, the electrical contact elements 206 further include Insulation Displacement Contacts (IDCs) 208 at their respective second ends, that is, the opposite terminating ends to the socket 202 where the plug is inserted. Each IDC 208 is preferably formed from a contact element which is bifurcated so as to define two opposed contact portions separated by a slot into which an insulated wire may be pressed so that edges of the contact portions engage and displace the insulation and such that the contact portions resiliently engage and make electrical connection with the conductor of the insulated wire. The described IDCs 208 are taught by U.S. Pat. No. 4,452,502 and U.S. Pat. No. 4,405,187, for example.

The electrical connector 100 includes two portions 102, 104 that are slideably coupled together. The first portion 102 includes:

1. Socket 202 for receiving a terminal end of the plug;
2. Internal slots 212 in a cavity 106 (FIG. 2) for seating first ends 204 of the electrical contact elements 206; and
3. Recesses 214 for attachment to the second portion 104.

The second portion 104 includes:

1. Pedestal projections 210 defining slots therebetween through which insulated conductors can be pressed into the corresponding IDCs 208 seated therein;
2. Internal slots (not shown) for seating mid sections of the electrical contact elements 206; and
3. Projections 216 (FIGS. 4 and 5) arranged to lock into the recesses 214 of the first portion 102.

In assembling the components of the electrical connector 100, the electrical contact elements 206 are first seated in the second portion 104 such that the IDCs 208 extend into respective openings defined between pedestal projections 210 and such that mid sections (not shown) of the contact elements are seated in respective internal slots. Secondly the first and second portions 102, 104 are slideably coupled together by movement in a direction substantially transverse to the direction of insertion of the plug into the socket 202. The direction of movement is defined by the relative positions of the recesses 214 and projections 216. During this second step, the first ends 204 and intermediate lengths of the electrical contact elements 206 enter into the cavity 106 through a top entrance 110 and move towards respective internal slots 212. That is, the electrical contact elements move through a top entrance 110 in a direction transverse to the insertion direction of the plug as the first and second portions 102, 104 slide and lock together.

When assembled in accordance with the above described steps, the cavity 106 remains open and the electrical contact elements 206 therein are exposed to the environment around the electrical connector 100. As such, the connector may collect dust, dirt and other contaminants that enter into the cavity 106 through the top entrance 110. These contaminants have the potential to degrade the electrical and/or mechanical operation of the electrical connector 100.

To inhibit ingress of contaminants into the cavity 106, the electrical connector 100 includes a third portion in the form of a dust cover 108, which is removably couplable to the first portion 102 of the electrical connector 100. The cover can be coupled to the first portion 102 in a third assembly step. The dust cover 108 is attachable over the top entrance 110 to the cavity 106 to inhibit ingress of contaminants into the cavity 106.

To facilitate convenient assembly of the dust cover 108 with the first portion 102, the dust cover is rotationally symmetric about 180 degrees around an axis perpendicular to the plane of an outer surface 112 of the dust cover 108. This means the dust cover 108 can be attached to the second portion 102 in either of two 180-degree rotationally-opposed orientations with respect to the electrical connector. This is advantageous for convenient alignment of the dust cover 108 and second portion 102 before attachment. Alternatively, the dust cover 108 can be formed in any suitable shape for coupling to and closing over the cavity 106.

As particularly shown in FIGS. 1, 5 and 10 to 14, the dust cover 108 is coupled to the first portion 102 of the electrical connector 100 by action of resilient projections 114 on the dust cover 108 which lock into corresponding recesses 116 on the first portion 102.

The dust cover 108 includes two pairs 118 of the resilient projections 114. The two resilient projections 114 of each pair are disposed directly opposed on opposite sides of the dust cover 108. As particularly shown in FIGS. 14A to 14C, each resilient projection 114 includes an angled camming surface 120, a locking surface 122 and a locking ledge 124.

The resilient projections 114 in the pair 118 are adapted to flex in substantially opposing directions (i.e. apart).

Figure 11:
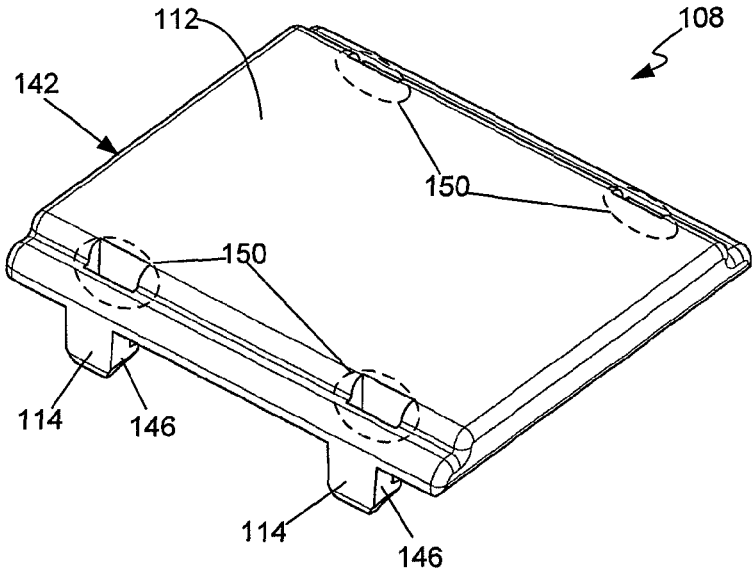
FIG. 11 is a perspective view of the top of the dust cover shown in FIG. 1.
Figure 12:
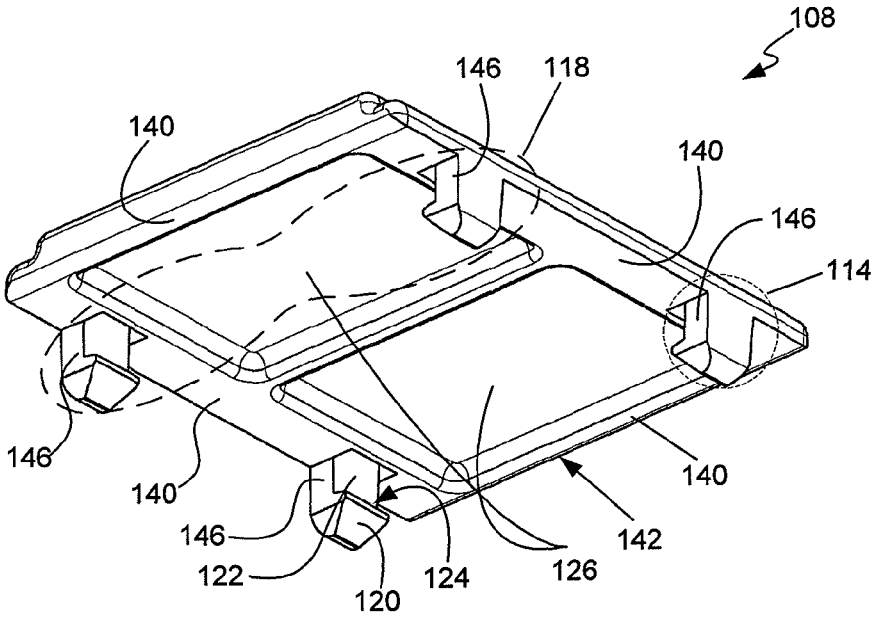
FIG. 12 is a perspective view of the bottom of the dust cover shown in FIG. 11.
Figure 13:
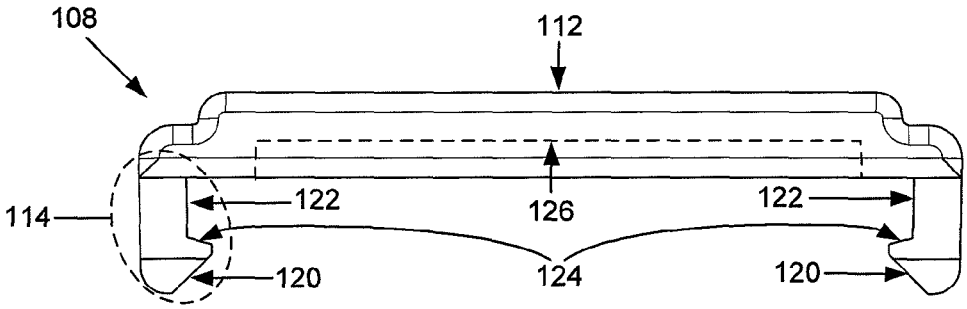
FIG. 13 is a front view of the dust cover shown in FIG. 11.
Figure 14:
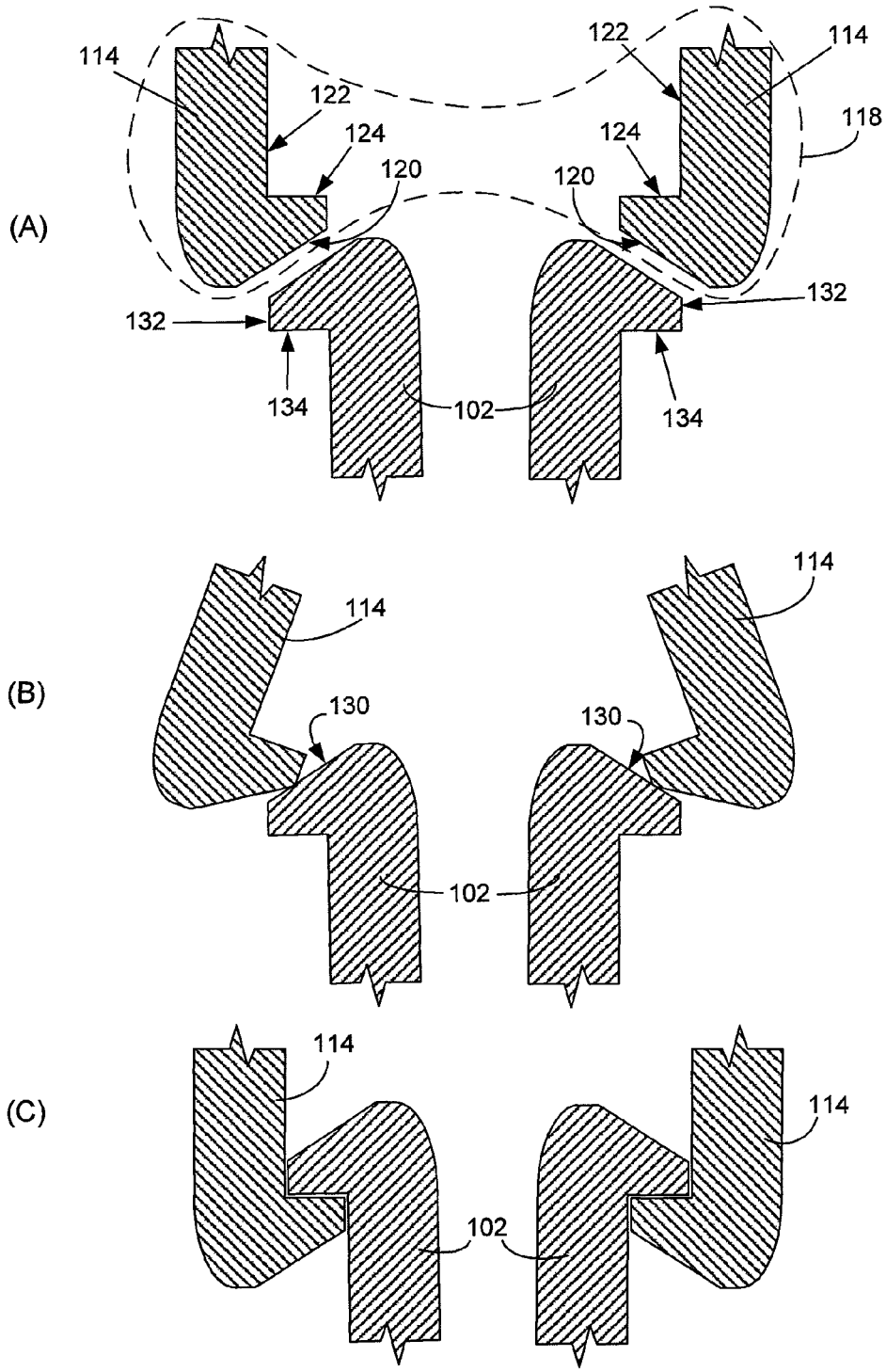
FIG. 14A is a diagrammatic illustration showing a cross-section view of two resilient projections of the dust cover and corresponding projections of the connector to which the cover can be secured.
FIG. 14B is a diagrammatic illustration showing a cross-section view of the projections shown in FIG. 14A arranged in another condition of use.
FIG. 14C is a diagrammatic illustration showing a cross-section view of the projections shown in FIG. 14A arranged in yet another condition of use.

The covering surface of the dust cover 108, i.e. that lying between the outer surface 112 and an inner surface 126 (FIGS. 12 and 13), is selected to be of sufficient thickness to rigidly hold the resilient projections 114 in their original orientation, as shown in FIGS. 11 to 13.

During assembly, the dust cover 108 is attached to the second portion 102 to cover the top entrance 110 of the cavity 106. In a first step of the attachment process, the dust cover 108 is arranged over the cavity 106 such that the projections 114 are located over corresponding recesses 116 in the manner shown in FIG. 14A. The dust cover 108 is then pressed into position. In doing so, an outward flexing force (i.e. directing the resilient projections 114 in each pair 118 apart from the other) is applied by the camming surface 120 of each resilient projection 114 by contact with a substantially rigid ridge 130 of the first portion 102. The pair 118 flexes apart in the manner shown in FIG. 14B as the dust cover 108 is moved closer into engagement with the first portion 102. The pair 118 then returns to its initial orientation by its natural resilience when the dust cover has been attached over the top entrance 110 as shown in FIG. 14C.

When attached in the manner shown in FIG. 11, the dust cover 108 is retained substantially in place over the cavity 106 by the locking surface 122 and the locking ledge 124. The two locking surfaces 122 of the pair 118 of resilient projections 114 abut opposed cooperating substantially rigid catching surfaces 132 of the first portion 102. The dust cover 108 is thereby retained substantially in place along a first axis. The two locking ledges 124 of each pair 118 abut non-opposed cooperating substantially rigid catching ledges 134 of the first portion 102, creating a force on the dust cover 108 that opposes the force applied by upper abutment edges 136 (FIGS. 4, 6 and 8) of the first portion 102 and second portion 104 on inner abutment surfaces 140 (FIG. 12) of the dust cover 108. The dust cover 108 is thereby substantially retained in place along a second axis. Finally, the dust cover 108 is held substantially in place along a third axis by the opposed forces between:

a. An end face 142 (FIGS. 1, 5 and 10 to 12) on the dust cover 108 and a projecting surface 144 (FIGS. 1, 2, 4, 5 and 10) on the first portion 102; and b. An outer side wall 146 (FIGS. 11 and 12) of at least one resilient projection 114, that is at the opposed end of the dust cover 108 from the end face 142, and at least one corresponding side wall 148 (FIGS. 4 and 8) in a recess of the first portion 102.

Although the dust cover 108 is preferably removable from the second portion 102, it is not intended to be readily removed once attached during assembly.

The electrical contact elements 206 in the cavity 106 undergo not insubstantial deformation when the plug is inserted into the connector through the socket 202. The plug, when inserted, exerts a force on the first ends 204 of electrical contact elements 206, for the purpose of creating a good electrical contact, and this force tends to deform the electrical contact elements 206 into the space of the cavity 106. Advantageously, therefore, the thickness of the dust cover 108 is selected to be such that the inner surface 126 (FIG. 13) does not intrude on the space required by deformation of the electrical contact elements 206 in the cavity 106.

The dust cover 108 is preferably formed by injection moulding of a plastic material that has an inherent natural resilience. During injection moulding of the dust cover 108, the locking surface 122 and locking ledge 124 of each resilient projection 114 are defined by moulding projections that project through recesses 150 (FIG. 11) in the outer surface 112 of the dust cover 108.

It is to be appreciated that the embodiments of the invention described above with reference to the accompanying drawings have been given by way of example only and that modification and additional components may be provided to enhance the performance of the apparatus.

Throughout this specification and the claims which follow, unless the context requires otherwise, the word 'comprise,' and variations such as 'comprises' and 'comprising,' will be understood to imply the inclusion of a stated integer or step, or group of stated integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

LIST OF PARTS

100 electrical connector
102,104 two portions
106 cavity
108 dust cover
110 top entrance
112 outer surface
114 resilient projections
116 recesses
118 pair
120 angled camming surface
122 locking surface
124 locking ledge
126 inner surface
130 rigid ridge
132 rigid catching surface
136 the upper abutment edges
140 inner abutment surfaces
142 end face
144 projecting surface
146 outer side wall
148 side wall
150 recesses
202 socket
204 first ends
206 electrical contact elements
208 Insulation Displacement Contacts (IDCs)
210 pedestal projections
212 internal slots
214 recesses
216 projections

The invention claimed is:

1. An electrical connector comprising:

(a) a housing defining a socket and including a plurality of electrical contact elements that are configured to electrically contact contacts of a mating plug when the plug is received in the socket;

(b) the housing defining a cavity, which is accessible through a top entrance defined in the housing, in which a substantial intermediate length of at least one of the electrical contact elements is exposed via the top entrance; and (c) a dust cover coupled to the housing at the top entrance to inhibit ingress of contaminants into the cavity, the dust cover being rotationally symmetric about 180 degrees around an axis perpendicular to a plane of an outer surface of the dust cover, the dust cover defining an inner surface that is spaced from the electrical contact elements.

2. The electrical connector claimed in claim 1, wherein the electrical contact elements are positioned in the cavity of the housing during assembly of the electrical connector by movement of the electrical contact elements through the top entrance in a direction transverse to an insertion direction of the plug.

3. The electrical connector claimed in claim 1, further comprising a plurality of insulation displacement contacts electrically connected to the electrical contact elements, and disposed at an opposite end of the electrical connector to the socket where the mating plug is inserted.

4. The electrical connector claimed in claim 3, wherein the housing includes a first portion seating the electrical contact elements and the dust cover; and a second portion seating the insulation displacement contacts.

5. The electrical connector claimed in claim 4, wherein the electrical connector is an RJ-type connector.

6. The electrical connector claimed in claim 1, wherein the dust cover is selectively attached in one of two 180-degree rotationally-opposed orientations with respect to the electrical connector.

7. The electrical connector claimed in claim 1, wherein the inner surface of the dust cover is spaced a sufficient distant from the electrical contact elements so as not to impede deformation thereof caused by insertion of the plug.

8. The electrical connector claimed in claim 1, wherein the dust cover includes projections extending in a common direction away from a body portion of the cover, the projections being at least partially adapted to flex during attachment of the dust cover over the top entrance of the cavity.

9. The electrical connector claimed in claim 8, wherein the projections are arranged in pairs; wherein the projections of each pair are disposed directly opposed on opposite sides of the dust cover; wherein each projection has an angled camming surface, a locking surface, and a locking ledge; wherein the projections of each pair are resilient and flex in substantially opposing directions during attachment of the dust cover over the top entrance of the cavity when the camming surface of each projection is forced over a rigid ridge of the electrical connector; and wherein each resilient projection returns by its natural resilience to a locking orientation when the dust cover has been attached over the top entrance, with the locking surface and the locking ledge acting to substantially retain the dust cover in place over the cavity.

10. The electrical connector claimed in claim 9, wherein only the resilient projections of the dust cover flex during the attachment.

11. The electrical connector claimed in claim 10, wherein the housing includes cooperating ledges, wherein each ledge defines one of the rigid ridges to engage the angled camming surface of one of the resilient projections; a substantially rigid catching surface to engage the locking surface of the resilient projection; and a substantially rigid catching ledge to engage with the locking ledge of the resilient projection.

12. The electrical connector claimed in claim 10, wherein the dust cover is formed by injection molding, and the locking surface and locking ledge of each resilient projection are defined during molding by molding projections that project through recesses in an outer surface of the dust cover.

13. An in-line RJ-type electrical connector comprising:

(a) a housing including a plurality of electrical contact elements to which electrical contact can be made with contacts of a mating plug by insertion of the plug into the housing, each of the electrical contacts including an insulation displacement contact at one end;

(b) the housing defining a cavity, which is accessible through a top entrance defined in the housing, in which a substantial intermediate length of at least one of the electrical contact elements is exposed via the top entrance, wherein the insulation displacement contact of the at least one electrical contact element is not exposed via the top entrance of the cavity; and (c) a dust cover coupled to the housing at the top entrance to inhibit ingress of foreign matter into the cavity, the dust cover defining an inner surface that is spaced from the electrical contact elements.

14. The electrical connector claimed in claim 13, wherein the electrical contact elements are positioned in the cavity of the housing during assembly of the electrical connector by movement of the electrical contact elements through the top entrance in a direction transverse to an insertion direction of the plug.

15. A method of assembling an electrical connector having first and second portions, comprising:

(a) seating a plurality of insulation displacement contacts, which are connected to a corresponding plurality of electrical contact elements, in the second portion;

(b) slideably inserting the second portion into the first portion so that the electrical contact elements move through a top entrance of the first portion and become seated in a corresponding plurality of internal slots in a cavity of the first portion;

(c) selecting one of two 180-degree rotationally-opposed orientations in which to attach a dust cover to the electrical connector; and (d) attaching a the dust cover over the top entrance of the cavity so that an inner surface of the dust cover is spaced from the electrical contact elements.

16. The method claimed in claim 15, wherein projections extending in a common direction outwardly from a body portion of the dust cover are adapted to flex during attachment at the top entrance of the cavity.

17. The method claimed in claim 16, wherein the projections are arranged in pairs; the projections of each pair being resilient to enable the projections to flex in substantially opposite directions during attachment of the dust cover at the top entrance of the cavity, a camming surface of each resilient projection being forced over a corresponding rigid ridge of the housing of the electrical connector; and each resilient projection returning by its natural resilience to a locking orientation when the dust cover has been attached at the top entrance, with a locking surface and a locking ledge acting of each resilient projection substantially retains the dust cover in place at the cavity.

18. The method claimed in claim 17, wherein only the resilient projections of the dust cover flex during the attachment.

19. The method claimed in claim 15, further comprising electrically connecting the electrical contact elements to mating plug contacts of a mating plug by inserting the mating plug into the electrical connector through a socket of the connector, the socket being transverse to the top entrance.

20. An electrical connector for electrically connecting electrically conductive insulated conductors of a first cable to corresponding electrically conductive insulated conductors of a second cable, comprising:

(a) a first portion including a socket shaped to at least partially receive a terminal end of a plug terminating the conductors of the first cable, the first portion also defining a cavity;

(b) a plurality of electrically conductive contact elements that include first ends at least partially extending into the socket for electrical connection to corresponding conductors of the first cable, and second ends including insulation displacement contacts for electrically connecting to corresponding conductors of the second cable;

(c) a second portion including a plurality of slots shaped to at least partially receive and locate respective ones of said contact elements in predetermined positions such that insulation displacement contacts of the contact elements extend into respective openings of the second portion for connection to corresponding conductors of the second cable; and (d) a cover coupled to the first portion over the cavity, the cover extending over only the first portion and not the second portion, the cover defining an inner surface that is spaced from the electrical contact elements;

wherein the cavity facilitates lateral movement of the first portion over the second portion when the contact elements are seated in respective slots of the second portion so as to couple the first portion to the second portion, and the cover inhibits ingress of foreign matter into the connector.

* * * * *